US006086398A

United States Patent [19]

Ookawa et al.

[11] Patent Number: 6,086,398

[45] Date of Patent: Jul. 11, 2000

[54] TERMINAL CONNECTION DEVICE

[75] Inventors: Yoshihiro Ookawa; Coichi Shichida; Yoshinori Uchida, all of Tokyo, Japan

[73] Assignee: Mitsubishi Denki Kabushiki Kaisha, Tokyo, Japan

[21] Appl. No.: 09/113,556

[22] Filed: Jul. 10, 1998

[30] Foreign Application Priority Data

Jul. 11, 1997 [JP] Japan ..... 9-186632

[51] Int. Cl.[7] ..... H01R 13/18

[52] U.S. Cl. ..... 439/251; 439/821

[58] Field of Search ..... 439/251, 821

[56] References Cited

U.S. PATENT DOCUMENTS 5,482,481 1/1996 Takeuchi ..... 439/251

FOREIGN PATENT DOCUMENTS 3-26928 3/1991 Japan .

*Primary Examiner*—Gary F. Paumen

*Attorney, Agent, or Firm*—Sughrue, Mion, Zinn, Macpeak & Seas, PLLC

[57] ABSTRACT

A terminal connection device comprising: a first terminal; a terminal contact member composed of a plurality of contact pieces, each contact piece having a first contact surface and a second contact surface, the plurality of contact pieces being arranged on an outer circumference of the first terminal so that the first contact surface and the first terminal can be contacted with each other; a guide plate located between the first contact surface and the second contact surface, recesses being formed on the guide plate at regular intervals in the outer circumferential direction; and a pushing means for pushing the terminal contact member from the outside of the terminal contact member, in that contact pieces are arranged in the recesses formed on the guide plate, the first terminal and the second terminal are electrically connected with each other when the second terminal is inserted into the terminal contact member so that the second contact surface and the second terminal can be contacted with each other, and a protrusion is formed on the side of the contact piece.

8 Claims, 6 Drawing Sheets

TERMINAL CONNECTION DEVICE

BACKGROUND OF THE INVENTION

The present invention relates to a terminal connection device for connecting a primary terminal of a switch or a circuit breaker with a terminal of a fixed frame.

FIG. 7 is a side view showing a conventional terminal connection device, and FIG. 8 is a view (a front view of the terminal connection device) of the terminal connection device shown in FIG. 7 from which the second terminal is pulled out, wherein the view is taken in the direction of arrow A.

FIGS. 9A and 9B are showing a structure of the conventional terminal connecting device shown in FIG. 7. FIG. 9A is a side view of a contact piece of the terminal connecting device described later, and FIG. 9B is a front view of the contact piece of the terminal connecting device. That is, FIG. 9B is a view of the contact piece of the terminal connecting device shown in FIG. 9A, wherein the view is taken in the direction of arrow B.

In the drawings, reference numeral 1 is a first terminal, the shape of which is, for example, a circular rod-shape. The first terminal is, for example, a terminal of a circuit breaker or a switch. Reference symbole "a" is a central axis of the first terminal. Reference numeral 2 is a contact piece arranged outside the first terminal 1.

The contact piece 2 is an electrically conductive member. When a plurality of contact pieces 2 are arranged along the outer circumferential direction on the side of the first terminal being formed into a ring-shape (in this case, a circle), the plurality of contact pieces 2 compose a terminal contact member 21.

Reference symbol R1 is a size of an outer diameter of the terminal contact member 21. Reference numeral 3 is a compression spring which is a pushing means for pushing the contact pieces 2. The compression spring 3 is arranged on the outer circumference of the terminal contact member 21 and presses the contact piece 2 to the first terminal 1 by giving a force from the outside of the contact piece 2 to the inside.

Each compression spring 3 is a ring-shaped spring. When the compression springs 3 are arranged in the recesses 2*e* to 2*g* formed in the contact piece 2, a force directed from the outside of the contact piece 2 to the inside can be given to the contact piece 2, that is, a force directed to the central axis "a" of the first terminal 1 can be given to the contact piece 2.

Reference numeral 4 is a first guide plate, and reference numeral 5 is a second guide plate. Reference numeral 6 is a second terminal, the shape of which is formed into a circular rod-shape. The second terminal 6 is, for example, a terminal of a fixing frame (not shown in the drawing) to be connected with a circuit breaker. Reference numeral 8 is a screw which is a fixing means for fixing the first terminal 1 to the first guide plate 4.

When the second terminal 6 is inserted into a space inside the terminal contact member 21 so that the contact piece 2 can be contacted with the second terminal 6, it is possible to attain a condition in which an electrical current flows between the first terminal 1 and the second terminal 6. Therefore, the first terminal 1 and the second terminal 6 are electrically connected with each other.

When the first terminal 1 and the second terminal 6 are electrically disconnected from each other, the second terminal 6 is pulled out from the terminal contact member 21.

At this time, since the contact piece 2 is fixed to the first terminal 1, the contact piece 2 is left on the outer circumference of the first terminal 1. Therefore, the second contact surface 2*b* become hollow.

In the case of replacing parts arranged on the side of the first terminal 1, after the first terminal 1 and the second terminal 2 have been electrically disconnected from each other, the predetermined parts are replaced.

FIG. 10 is a view showing a structure of the first guide plate 4.

As shown in FIG. 10, the first guide plate 4 is composed in such a manner that a plurality of recesses 4*a* are formed at regular intervals on the outer circumference of a circular plate.

A plurality of contact pieces 2 are arranged on the outer circumference of the first terminal 1 being formed into a circle when the recesses 2*c* of the contact pieces 2 are put in the recesses 4*a* of the first guide plate 4.

Side walls 4*b* of the recesses 4*a* prevent the contact pieces 2 from being displaced in the transverse direction or in the outer circumferential direction of the first terminal.

When a screw 8 is put in a screw hole 4*c* formed on the first guide plate 4, the first guide plate 4 is fixed to the first terminal 1.

FIG. 11 is a view showing a structure of the second guide plate 5.

As shown in FIG. 11, the second guide plate 5 is an annular member composed in such a manner that a plurality of recesses 5*a* are formed at regular intervals on the outer circumference of the annular member.

A plurality of contact pieces 2 are arranged on the outer circumference of the second terminal 6 being formed into a circle when the recesses 2*d* of the contact pieces 2 are put in the recesses 5*a* of the second guide plate 5.

Side walls 5*b* of the recesses 5*a* prevent the contact pieces 2 from being displaced in the transverse direction.

Inner diameter R of the second guide plate 5 is determined to be larger than the diameter of the second terminal 6 so that the second terminal 6 can be pulled out.

When the second terminal 6 is pulled out from the terminal contact member 21, a bottom surface of the recess 5*a* of the second guide plate 5 supports the contact piece 2, and a tip end portion of the contact piece 2 on the contact surface side 2*b* is prevented from being displaced toward the central axis "a" of the first terminal 1.

FIG. 12 is a schematic illustration showing a distribution of forces given to the contact piece 2.

In FIG. 12, RA is a pushing force given from the first contact surface 2*a* to the first terminal 1, RB is a pushing force given from the second contact surface 2*b* to the second terminal 6, and P is a pushing force given by the compression spring 3.

When the compression springs 3 are arranged at regular intervals as shown in the drawing, pushing force RA given between the first terminal 1 and the contact piece 2 becomes equal to pushing force RB given between the second terminal 6 and the contact piece 2.

In order to prevent the tip end portion of the contact piece 2 on the second contact surface 2*b* side from being displaced toward the central axis "a" of the first terminal 1 when the second terminal 6 is pulled out and in order to support the tip end portion of the contact piece 2 on the second contact surface 2*b* side, the first guide plate 4 and the second guide plate 5 are used in the conventional terminal connection device. However, in the above conventional terminal connection device, there is caused a problem that the number of parts composing the terminal connection device is increased.

In addition when the two guide plates are integrated into one, an amount of displacement of the tip end portion of the contact piece 2 on the second contact surface 2*b* side toward the central axis of the first terminal is increased too much after the second terminal 6 has been pulled out. Therefore, it becomes impossible to insert the second terminal 6 again.

SUMMARY OF THE INVENTION

The present invention has been accomplished to solve the above problems. It is an object of the present invention to provide a terminal connection device in which the tip end portion of the contact piece on the second contact surface side can be prevented from being displaced toward the central axis of the first terminal, even if only one guide plate is provided.

The present invention is to provide a terminal connection device comprising: a first terminal; a terminal contact member composed of a plurality of contact pieces, each contact piece having a first contact surface and a second contact surface, the plurality of contact pieces being arranged on an outer circumference of the first terminal so that the first contact surface and the first terminal can be contacted with each other; a guide plate located between the first contact surface and the second contact surface, recesses being formed on the guide plate at regular intervals in the outer circumferential direction, and a pushing means for pushing the terminal contact member from the outside of the terminal contact member, wherein the contact pieces are arranged in the recesses formed on the guide plate, the first terminal and the second terminal are electrically connected with each other when the second terminal is inserted into the terminal contact member so that the second contact surface and the second terminal can be contacted with each other, and a protrusion is formed on the side of the contact piece.

In the terminal connection device according to the present invention, the pushing means is composed of a plurality of ring-shaped springs, and the plurality of ring-shaped springs are arranged outside the terminal contact member so that a pushing force given from the first contact surface of the contact piece can be higher than a pushing force given from the second contact surface of the contact piece.

In the terminal connection device according to the present invention, the protrusion is formed on the side of the contact piece close to the second contact surface of the contact piece.

In the terminal connection device according to the present invention, the first contact surface of the contact piece is curved so that a surface contact can be attained between the first terminal and the contact piece in the outer circumferential direction of the first terminal.

In the terminal connection device according to the present invention, the second contact surface of the contact piece is curved so that a surface contact can be attained between the second terminal and the contact piece in the outer circumferential direction of the second terminal.

DETAILED DESCRIPTION OF THE PREFERRED EMBODIMENTS

Embodiment 1

Figure 1:
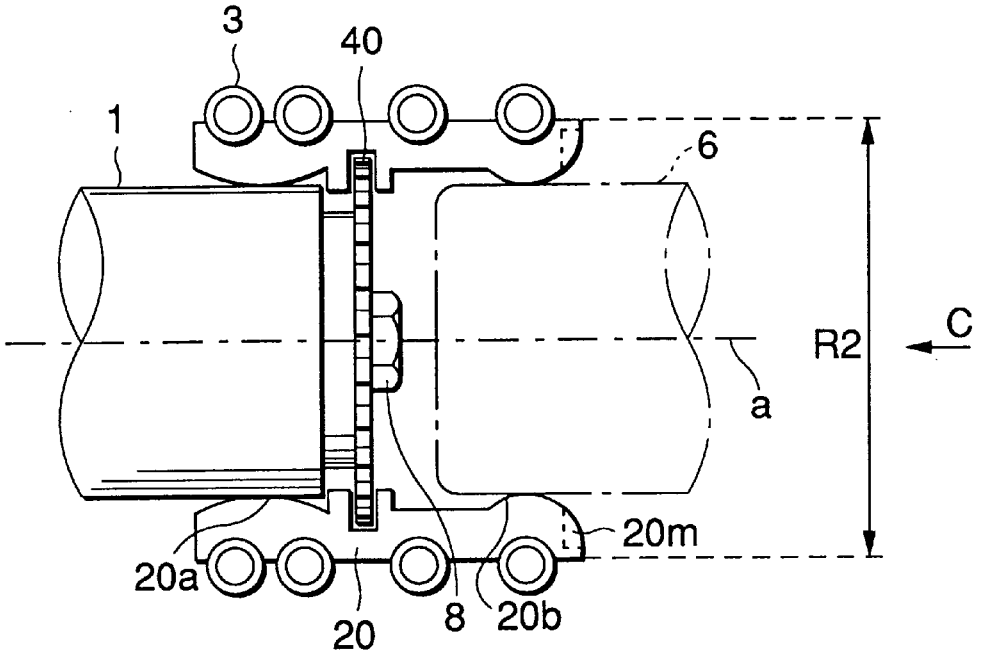
FIG. 1 is a partially cross-sectional view of the side of the terminal connection device of Embodiment 1.
Figure 2:
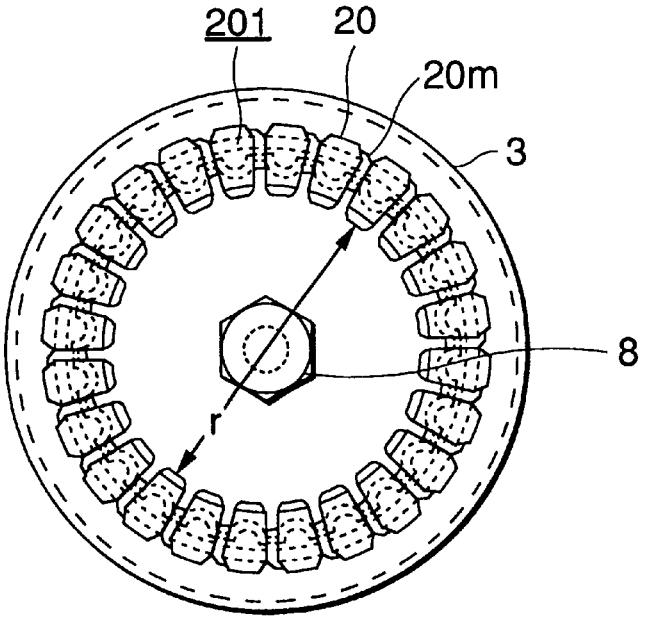
FIG. 2 is a front view of the terminal connection device of Embodiment 1.

FIG. 1 is a partially cross-sectional view of the side of the terminal connection device of Embodiment 1 of the invention. FIG. 2 is a view (a front view of the terminal connection device) of the terminal connection device shown in FIG. 1 from which the second terminal is pulled out, wherein the view is taken in the direction of arrow C.

Figure 3A:
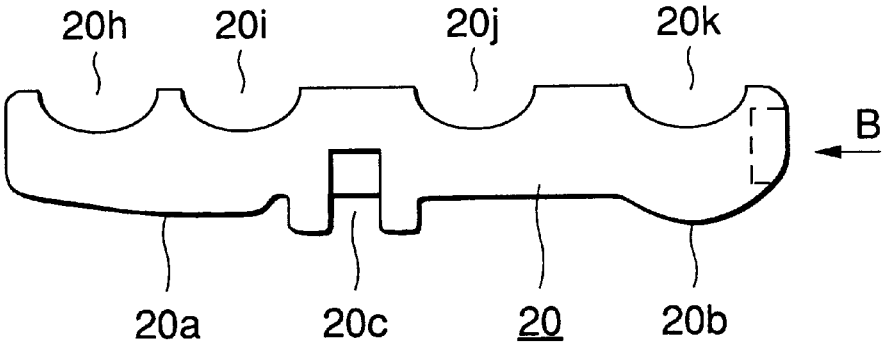
FIGS. 3A and 3B is a view showing the structure of the contact piece of the terminal connection device of Embodiment 1.
Figure 3B:
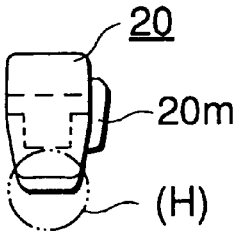
Figure 4:
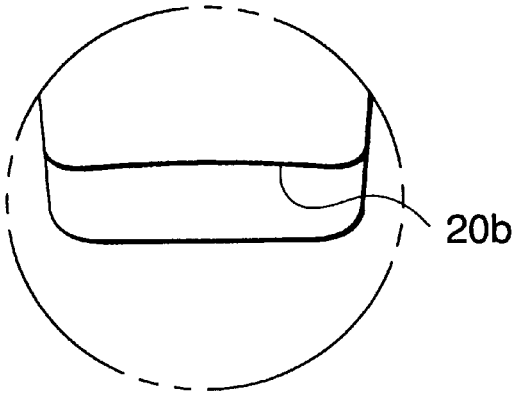
FIG. 4 is a partially enlarged view of the contact piece of the terminal connection device of Embodiment 1.
Figure 5:
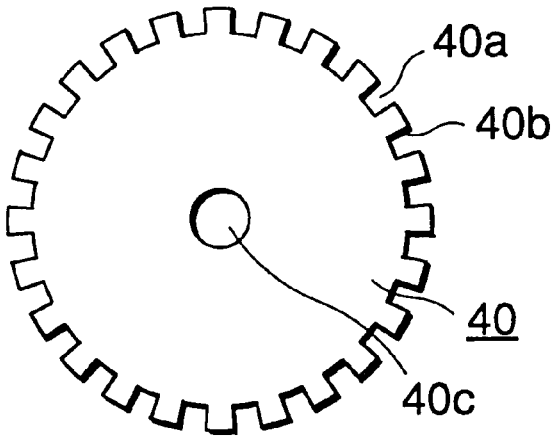
FIG. 5 is a view showing the structure of the guide plate of the terminal connection device of Embodiment 1.

FIG. 3A is a side view of the contact piece, and FIG. 3B is a front view taken in the direction of arrow B in FIG. 3A. FIG. 4 is an enlarged view of the contact surface of the contact piece. FIG. 5 is a front view of the guide plate. Like reference characters are used to indicate like parts in the views of the terminal connection device of the embodiment and the conventional terminal connection device.

In the drawings, reference numeral 20 is a contact piece arranged outside the first terminal 1. The contact piece 20 is a conductive member. A terminal contact member 201 is composed of a plurality of contact pieces 20 which are arranged in a ring-shape (in this case, a circular shape) on the side of the first terminal 1 in the outer circumferential direction.

The contact piece 20 includes: a first contact surface 20*a* coming into contact with the first terminal 1; a second contact surface 20*b* coming into contact with the second terminal 6; recesses 20*h*, 20*i*, 20*j*, 20*k* for preventing a positional displacement of the compression spring 3 which is a pushing means; a recess 20*c* in which the guide plate 40 is put; and a protrusion 20*m* formed on the side of the contact piece 20 close to the second contact surface 20*b*. A section of the contact piece 20 is formed into a substantial sector.

R2 is an outer diameter of the terminal contact member 201, and r is an inner diameter of the terminal contact member 201.

When the second terminal 6 is pulled out, a tip end portion of each contact piece 20 on the second contact surface 20*b* side is inclined toward the central axis "a" of the first terminal 1 so that the contact pieces, which are adjacent to each other, are contacted with each other via the protrusion 20*m*.

The protrusion 20*m* prevents the tip end portion of the contact piece 20 on the second contact surface 20*b* side from inclining excessively.

That is, the protrusion 20*m* functions as a stopper which restricts an excessively large inclination of the tip end portion of the contact piece 20 on the second contact surface 20*b* side. Therefore, even if only one guide plate 40 is provided, the inner diameter "r" of the contact pieces 20, which are arranged in a circle, is not reduced so small. Due to the foregoing, the second terminal 6 can be easily inserted again.

The recess 20*h* is formed at a position closer to the recess 20*c* than the recess 20*k*.

A distance from the recess 20*i* to the recess 20*c* is substantially the same as a distance from the recess 20*j* to the recess 20*c*.

Due to the above arrangement, when the compression springs 3 are arranged in the recesses 20*h* to 20*k*, a pushing force given to the first terminal 1 from the first contact surface 20*a* becomes higher than a pushing force given to the second terminal 6 from the second contact surface 20*b*. Therefore, when the second terminal 6 is pulled out, there is no possibility that the first contact surface 20*a* is separated from the first terminal 1.

FIG. 4 is a partially enlarged view of the contact piece 20. To be in more detail, FIG. 4 is a partially enlarged view of a portion H of the contact piece 20 shown in FIG. 3A.

The second contact surface 20*b* is, for example, a curved surface which comes into surface contact with a surface of the second terminal 6. In this embodiment, the second terminal 6 is formed into a circular rod-shape. Therefore, the second contact surface 20*b* is curved.

Since a curved surface is formed on the second contact surface 20*b* as shown in FIG. 4, the second contact surface 20*b* comes into surface contact with the surface of the second terminal 6.

Due to the foregoing, a contact area of the second contact surface 20*b* with the second terminal 6 is increased. Accordingly, the contact resistance between them can be decreased, and a limit value of electric current flowing between the second contact surface 20*b* and the second terminal 6 can be increased. As a result, quality of the terminal contact device can be enhanced.

In the same manner as that described above, when the first contact surface 20*a* is curved so that it can come into surface contact with a surface of the first terminal 1, the same effect can be provided because the first terminal 1 is formed into a circular rod-shape.

Figure 7:
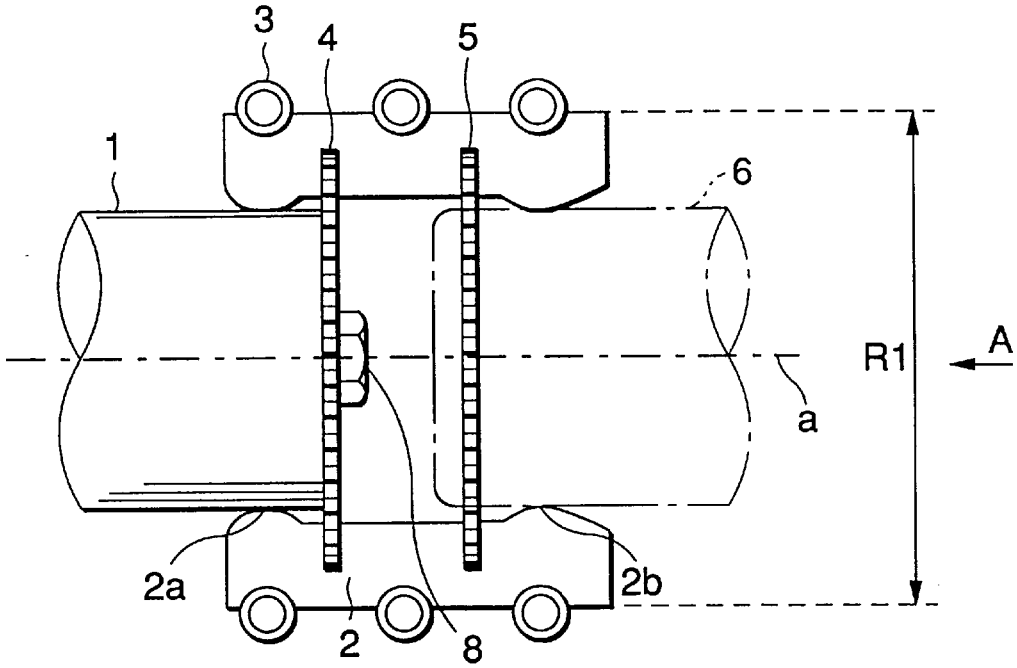
FIG.7 PRIOR ART
FIG. 7 is a partially cross-sectional view of the side of the conventional terminal connection device.
Figure 8:
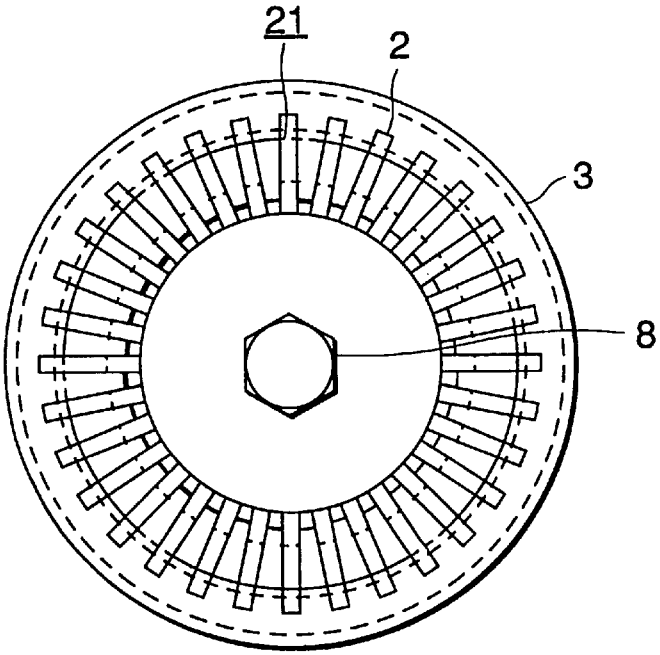
FIG.8 PRIOR ART
FIG. 8 is a front view of the conventional terminal connection device.
Figure 9A:
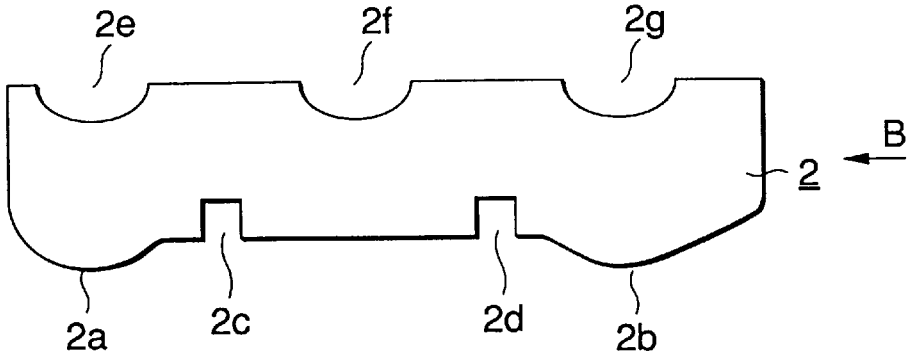
FIG.9A PRIOR ART
FIGS. 9A and 9B is a view showing the structure of the contact piece of the conventional terminal connection device.
Figure 9B:
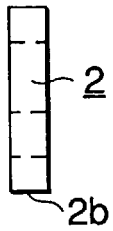
FIG.9B PRIOR ART
Figure 10:
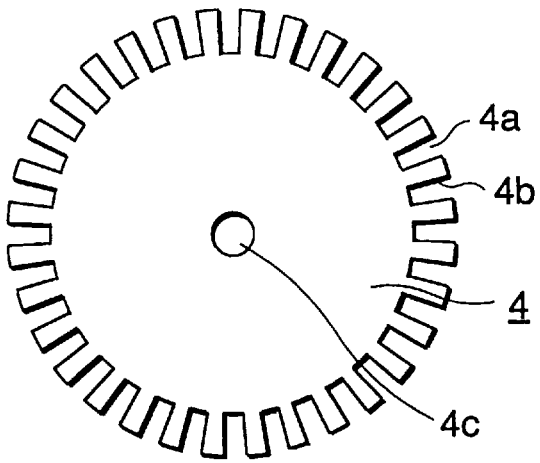
FIG.10 PRIOR ART
FIG. 10 is a view showing the structure of the first guide of the conventional terminal connection device.
Figure 11:
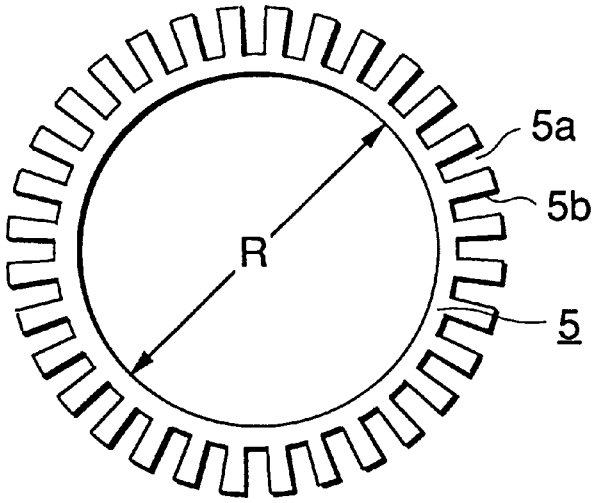
FIG.11 PRIOR ART
FIG. 11 is a view showing the structure of the second guide of the conventional terminal connection device.
Figure 12:
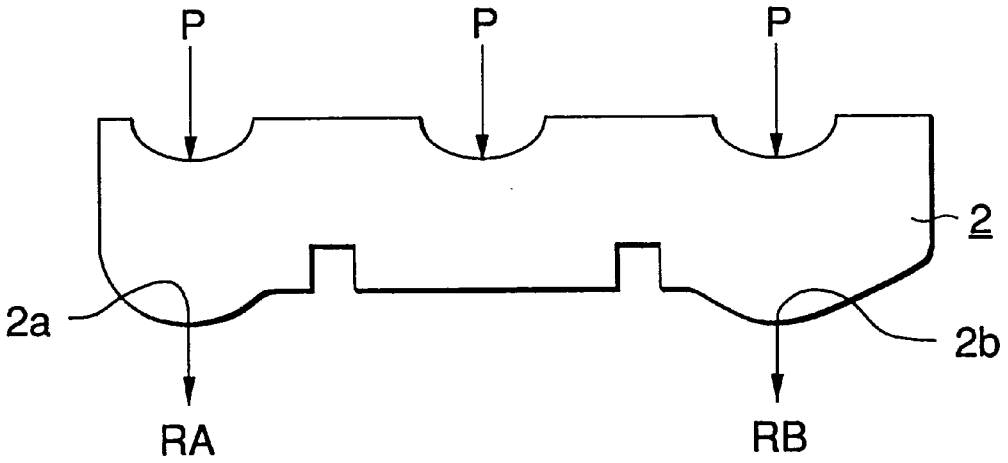
FIG.12 PRIOR ART
FIG. 12 is a schematic illustration showing a distribution of forces given to the contact piece of the conventional terminal connection device.

In the case where a cross-sectional area of the contact piece 20, the cross-section of which is a sector, is increased, it is possible to increase the cross-sectional area of the contact piece 20 by increasing a length of the cross-section in the transverse direction, that is, by increasing a length of the cross-section shown in FIG. 3B in the transverse direction on the surface of the drawing. As described above, it is possible to increase the contact area of the second contact surface 20*b* coming into contact with the second terminal 6. Therefore, it is possible to reduce an electric current density of the electric current flowing in the contact pieces without increasing the outer diameter of the terminal contact member 201, which is represented by R2 in FIG. 1, compared with the outer diameter of the conventional terminal contact member 21, whigh is represented by R1 in FIG. 7.

FIG. 5 is a view showing a structure of the guide plate 40.

As shown in FIG. 5, the guide plate 40 is composed in such a manner that a plurality of recesses 40*a* are formed at regular intervals on the outer circumference of a circular plate.

A plurality of contact pieces 20 are arranged on the outer circumference of the first terminal 1 being formed into a ring-shape (in this case, a circle) when the recesses 20*c* of the contact pieces 20 are put in the recesses 40*a* of the guide plate 40.

Side walls 40*b* of the recesses 40*a* prevent the contact pieces 20 from being displaced in the transverse direction.

When a screw 8 is put in a screw hole 40*c* formed on the guide plate 40, the guide plate 40 is fixed to the first terminal 1.

Figure 6:
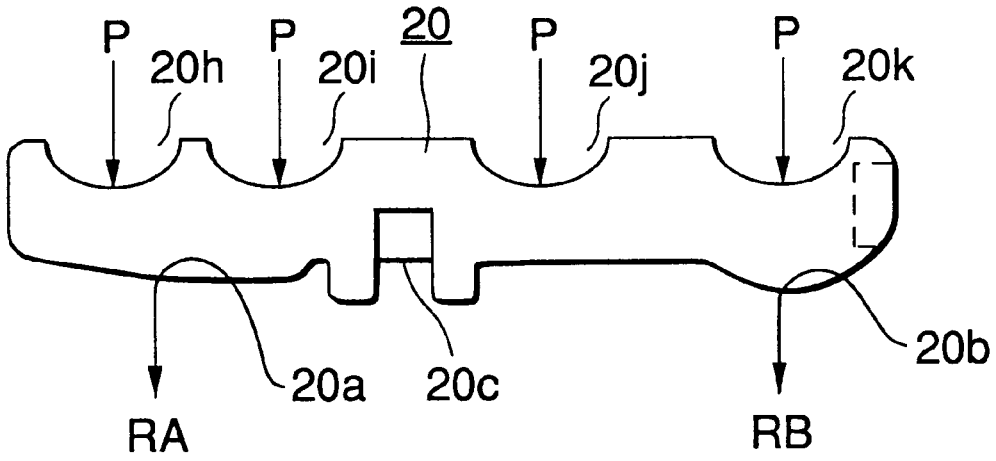
FIG. 6 is a schematic illustration showing a distribution of forces given to the contact piece of the terminal connection device of Embodiment 1.

FIG. 6 is a schematic illustration showing a distribution of forces given to the contact piece 20.

In the drawing, P is a pushing force given by each compression spring 3 to the contact piece 2 when the compression springs 3 are respectively arranged in the hollows 20*h* to 20*k*.

RA is a pushing force given from the first contact surface to the first terminal 1, and RB is a pushing force given from the second contact surface to the second terminal 6.

The first contact surface 20*a* is located at a position perpendicularly below a middle point of the hollows 20*h* and 20*i*. Due to the foregoing, an intensity of the pushing force given from the first contact surface 20*a* to the first terminal 1 becomes substantially twice as high as an intensity of force P.

Due to the foregoing, pushing force RA given from the first contact surface 20*a* to the first terminal 1 is increased, so that a contact resistance between the first terminal 1 and the first contact surface 20*a* can be reduced. Therefore, a limit value of electric current flowing between the first terminal 1 and the first contact surface 20*a* can be increased. As a result, quality of the terminal contact device can be enhanced.

On the other hand, the second contact surface 20*b* is located perpendicularly below the recess 20*k*, and the recess 20*j* is located at a position closer to the recess 20*c* than the second contact surface 20*b*.

Due to the above arrangement, an intensity of the pushing force given from the second contact surface 20*b* to the second terminal 6 becomes substantially equal to an intensity of force P.

Due to the foregoing, the second terminal 6 can be pulled out by the substantially same intensity of force as that of the force conventionally given to the second terminal 6, that is, the operation property of the terminal connection device of the invention is substantially the same as that of the conventional terminal connection device.

Due to the above arrangement, pushing force RA given from the first contact surface 20*a* to the first terminal 1 becomes higher than pushing force RB given from the second contact surface 20*b* to the second terminal 6. Therefore, when the second terminal 6 is pulled out, there is no possibility that the contact piece 2 is inclined to the side of the first contact surface 20*a*.

Concerning the method of adjusting pushing forces RA and RB, pushing force RA given from the first contact surface 20*a* to the first terminal 1 and pushing force RB given from the second contact surface 20*b* to the second terminal 6 can be adjusted by adjusting the positions of the hollows 20*h* to 20*k* for fixing the positions of the compression springs 3 and also adjusting the positions of the first contact surface 20*a* and the second contact surface 20*b*. However, the structure is not limited to the above specific embodiment. As long as the contact piece 20 is pushed in such a manner that pushing force RA can be higher than pushing force RB, any pushing means may be adopted.

In Embodiment 1, a circuit breaker is taken as an example to be arranged on the first terminal 1 side. However, even in the case where the device on the first terminal 1 side is a switch, of course, the same effect can be provided.

In Embodiment 1, the protrusion 20*m* is provided only on one side of the contact piece 20, however, the same effect can be provided when the protrusions 20*m* are provided on both sides of the contact piece 20.

In Embodiment 1, the protrusion 20*m* is provided on the side of the contact piece 20 close to the second contact surface 20*b*, however, the same effect can be provided when a tapered protrusion 20*m* is provided on the side of the contact piece 20.

According to the terminal connection device of the present invention, there is provided a protrusion on the side of the contact piece. Therefore, the protrusion functions as a stopper for preventing the tip end portion of the contact piece on the second contact surface side from inclining excessively toward the central axis of the first terminal. Accordingly, the inner diameter of the terminal contact member, in which a plurality of contact pieces are arranged in a ring-shape, is not reduced so small. Due to the foregoing, the second terminal 6 can be easily inserted into the terminal contact member again.

According to the terminal connection device of the present invention, the guide plate is arranged between the first contact surface and the second contact surface of the contact piece, and force is given to the contact pieces by a pushing means including a plurality of ring-shaped springs which are arranged outside the contact pieces so that a pushing force given from the first contact surface to the first terminal can be higher than a pushing force given from the second contact surface to the second terminal. Accordingly, when the second terminal is pulled out, the contact pieces are not inclined to the first contact surface side.

According to the terminal connection device of the present invention, the protrusion is provided on the side of the contact piece close to the second contact surface. Therefore, it is possible to easily eliminate a positional slippage in a portion close to the end of the second contact surface of the contact piece.

According to the terminal connection device of the present invention, the first contact surface of the contact piece is formed into a curved surface capable of coming into surface contact with the surface of the first terminal. Therefore, the contact area of the surface of the first terminal with the first contact surface can be increased, and the contact resistance in this contact area is decreased. Due to the foregoing, a limit value of the electrical current flowing between the first terminal and the first contact surface can be increased. Therefore, quality of the terminal connection device can be enhanced.

According to the terminal connection device of the present invention, the second contact surface of the contact piece is formed into a curved surface capable of coming into surface contact with the surface of the second terminal. Therefore, the contact area of the surface of the second terminal with the second contact surface can be increased, and the contact resistance in this contact area is decreased. Due to the foregoing, a limit value of the electrical current flowing between the second terminal and the second contact surface can be increased. Therefore, quality of the terminal connection device can be enhanced.

What is claimed is:

1. A terminal connection device comprising:

a first terminal;

a terminal contact member composed of a plurality of contact pieces, each contact piece having a first contact surface and a second contact surface, the plurality of contact pieces being arranged on an outer circumference of the first terminal so that the first contact surfaces and the first terminal can be contacted with each other;

a guide plate located between the first contact surfaces and the second contact surfaces, recesses being formed on the guide plate at regular intervals in an outer circumferential direction; and a pushing means for pushing the terminal contact member from the outside of the terminal contact member;

wherein the contact pieces are arranged in the recesses formed on the guide plate, the first terminal being electrically connected to a second terminal when the second terminal is inserted into the terminal contact member so that the second contact surfaces and the second terminal can be contacted with each other, and wherein a protrusion is formed on a side of the contact piece facing an adjacent one of said contact pieces.

2. A terminal connection device according to claim 1, wherein the pushing means is composed of a plurality of ring-shaped springs, and the plurality of ring-shaped springs are arranged outside the terminal contact member so that a pushing force given from the first contact surface of the contact piece can be higher than a pushing force given from the second contact surface of the contact piece.

3. A terminal connection device according to claim 1, wherein the protrusion is formed on the side of the contact piece close to the second contact surface of the contact piece.

4. A terminal connection device according to claim 1, wherein the first contact surface of the contact piece is curved so that a surf ace contact can be attained between the first terminal and the contact piece in the outer circumferential direction of the first terminal.

5. A terminal connection device according to claim 1, wherein the second contact surface of the contact piece is curved so that a surface contact can be attained between the second terminal and the contact piece in the outer circumferential direction of the second terminal.

6. A terminal connection device according to claim 1, wherein said protrusion contacts said adjacent one of said contact pieces when said second terminal is disengaged with said first terminal.

7. A terminal connection device comprising:

a first terminal;

a terminal contact member composed of a plurality of contact pieces, each contact piece having a first contact surface and a second contact surface, the plurality of contact pieces being arranged on an outer circumference of the first terminal so that the first contact surfaces and the first terminal can be contacted with each other;

a guide plate located between the first contact surfaces and the second contact surfaces, recesses being formed on the guide plate at regular intervals in an outer circumferential direction; and a pushing member to push the terminal contact member from the outside of the terminal contact member;

wherein the contact pieces are arranged in the recesses formed on the guide plate, the first terminal being electrically connected to a second terminal when the second terminal is inserted into the terminal contact member so that the second contact surfaces and the second terminal can be contacted with each other, and wherein a protrusion is formed on a side of the contact piece facing an adjacent one of said contact pieces.

8. A terminal connection device according to claim 7, wherein said protrusion contacts said adjacent one of said contact pieces when said second terminal is disengaged with said first terminal.

* * * * *